US010392230B2

(12) United States Patent
Qi et al.

(10) Patent No.: US 10,392,230 B2
(45) Date of Patent: Aug. 27, 2019

(54) SYSTEM AND METHOD FOR TESTING AN ESCALATOR

(71) Applicants: GUANGDONG INSPECTION AND RESEARCH INSTITUTE OF SPECIAL EQUIPMENT, ZHUHAI INSPECTION INSTITUTE, Zhuhai, Guangdong Province (CN); ZHUHAI ANYES TECHNOLOGY CO., LTD., Zhuhai, Guangdong Province (CN)

(72) Inventors: Zhengwu Qi, Zhuhai (CN); Minjian Liang, Zhuhai (CN); Yuhang Su, Zhuhai (CN); Yinghong Chen, Zhuhai (CN)

( * ) Notice: Subject to any disclaimer, the term of this patent is extended or adjusted under 35 U.S.C. 154(b) by 159 days.

(21) Appl. No.: 15/509,963

(22) PCT Filed: Nov. 3, 2015

(86) PCT No.: PCT/CN2015/093649
§ 371 (c)(1),
(2) Date: Mar. 9, 2017

(87) PCT Pub. No.: WO2016/101708
PCT Pub. Date: Jun. 30, 2016

(65) Prior Publication Data

US 2017/0305724 A1 Oct. 26, 2017

(30) Foreign Application Priority Data

Dec. 26, 2014 (CN) ..... 2014 1 0834570

(51) Int. Cl.
*B66B 25/00* (2006.01)
*B66B 27/00* (2006.01)
*B66B 29/00* (2006.01)

(52) U.S. Cl.
CPC ..... *B66B 25/006* (2013.01); *B66B 27/00* (2013.01); *B66B 29/005* (2013.01)

(58) Field of Classification Search
CPC ..... B66B 25/006; B66B 27/00; B66B 29/005
(Continued)

(56) References Cited

FOREIGN PATENT DOCUMENTS

CN 2690362 Y 4/2005
CN 201254423 Y * 6/2009
(Continued)

OTHER PUBLICATIONS

CN202974684UM, english translation of Chinese patent publication CN202974684U, 2013.*
(Continued)

*Primary Examiner* — Eric S. McCall
*Assistant Examiner* — Timothy P Graves
(74) *Attorney, Agent, or Firm* — Bycer Law, PLC; Matthew L. Bycer

(57) ABSTRACT

The present invention discloses an integrated test system and method for an escalator, the escalator comprises a control cabinet and a motor. The test system comprises a driver connected in series between the control cabinet and the motor for driving the escalator to simulate overspeed or unintentional reversal faults, a sensor mounted on a step or escalator handrail belt of the escalator for obtaining quantitative speed signals, and an operation device connected to the driver and the sensor for controlling the driver for different detection items and processing and displaying the speed signals. With the test system and method described herein, the defects of non-universal, unintuitive and non-quantitative nature, and low accuracy in the existing art are overcome. The test system of the invention is capable of
(Continued)

discovering a lot of hidden dangers of accidents and even system risks which are difficult to be found by the existing art.

9 Claims, 4 Drawing Sheets

(58) Field of Classification Search
USPC ..... 73/118.01
See application file for complete search history.

(56) References Cited

FOREIGN PATENT DOCUMENTS

| | | | | |
|---|---|---|---|---|
| CN | 202974684 | U | * | 6/2013 |
| CN | 103991783 | A | | 8/2014 |
| CN | 104528507 | A | | 4/2015 |
| CN | 204661114 | U | | 9/2015 |
| JP | 10279245 | A | * | 10/1998 |
| JP | H10279245 | A | | 10/1998 |

OTHER PUBLICATIONS

CN202974684UFORPAT, Chinese patent publication CN202974684U, 2013.*

* cited by examiner

SYSTEM AND METHOD FOR TESTING AN ESCALATOR

CROSS REFERENCE TO RELATED APPLICATIONS

The present application claims priority to and includes subject matter disclosed in PCT application No. PCT/CN2015/093649, filed Nov. 3, 2015, which claims priority to application No. CN 2014-10834570, filed Dec. 26, 2014, describing an invention made by the present inventors.

DESCRIPTION

Field of the Invention

The invention relates to a system and method for testing an escalator.

Background of the Invention

With the improvement of the people's living standards, escalators and walkways as a result of the progress of the times, bringing a lot of convenience, are also accompanied by many security problems, such as overspeed, unintentional reversal, cascade deletion and so on during the operation of the escalators and the walkways, which will cause some harm to people.

For example, in a city, according to the present invention, escalators numbered 487 are detected in 56 types of 39 brands, wherein failures of overspeed protection function are 97 units in 13 types of 4 brands, a failure rate is 19.9%; unintentional reversal protection function failures are 18, containing 6 types of 4 brands, a failure rate is 3.7%, there is a systemic risk in a number of brands of the escalators. However, existing test systems and methods for an escalator exist defects, such as universal, not intuitive and so on, especially the detection of escalator overspeed and unintentional reversal protection function can not be detected accurately, not detected and not make quantitative detection, and other problems. Regarding these problems, there is left blank technology at home and abroad.

SUMMARY OF THE INVENTION

To solve the above problems, the invention provides an integrated testing system and method for an escalator. With the system and method described herein, the defects of non-universal, unintuitive and non-quantitative nature, and low accuracy in the existing art are overcome. In practice the test system of the invention is capable of discovering a lot of hidden dangers of accidents and even system risks which are difficult to be found by the existing art.

The technical solutions adopted by the invention to solve the technical problems are as follows:

A system for testing an escalator comprises a control cabinet; a motor; an actuator, connected in series between the control cabinet and the motor, for actuating the escalator to simulate overspeed or reversal; at least one sensor, mounted on a step or a handrail belt of the escalator for quantitative detection of speed signals; and an operation device, connected to the actuator and the sensor, controlling the actuator for different test items, and processing and displaying the speed signals detected.

As an improvement of the technical solution, based on variable-frequency, the actuator changes the running speed and direction of the escalator by varying the power frequency and phase of the motor, for overspeed or reversal simulation.

As an improvement of the technical solution, the actuator is connected to the operation device via a control line, of which input and output interfaces are aviation joints.

As an improvement of the technical solution, the operation device is integrated with an overspeed protection testing module, an unintentional reversal protection testing module, a speed deviation testing module, a handrail synchronization error testing module, a braking distance and speed reduction testing module and a data recording module.

As an improvement of the technical solution, the sensor comprises a rubber wheel, a rotary encoder and a support, the rubber wheel and the rotary encoder are connected coaxially and mounted on a horizontal section of an apron of the escalator or a horizontal section of a glass wall of the escalator by the support.

As an improvement of the technical solution, the support comprises a suction cup through which the sensor is fixed, and a swing arm through which the sensor is in close contact with a horizontal section of a step of the escalator or a handrail belt of the escalator.

As an improvement of the technical solution, the operation device is a hand held manipulator, comprising a trigger.

A method for testing an escalator, with the system according to any one of claims 1-8, comprises the following steps:

Step 1. system startup: pressing a power switch of the operation device to initial the system and a communication test, if the communication test is passed, proceeding to next step;

Step 2. parameter setting: entering an ID number of an escalator to be tested and associated information of data to be measured in a parameter setting interface;

Step 3. test selection: selecting a specific functional test to enable the operation device to control the actuator to drive the escalator to simulate respective test conditions;

Step 4. real-time acquisition of data to be measured: acquiring the data of the step or the handrail belt in real-time by the operation device, and processing, displaying and saving the data; and Step 5. step repetition: repeating step 3 until the test is completed.

The invention has the following beneficial effects:

By integrating some advanced technologies, such as automatic control, power electronics, digital signal processing and so on, the system and method for testing an escalator according to the invention, by means of a driver, can simulate some dangerous conditions which may occur in operation, such as accidental overspeed, unintentional reversal and so on, to accurately sample, detect and estimate, thereby successfully solving the problem, that in the test of some protection functions against escalator overspeed and unintentional reversal, the detection is inaccurate and non-quantitative, even cannot be done, and filling the blank both home and abroad.

BRIEF DESCRIPTION OF THE DRAWINGS

The present invention will be further described in details hereinafter by embodiments and with reference to drawings, wherein.

DETAILED DESCRIPTION

Figure 1:
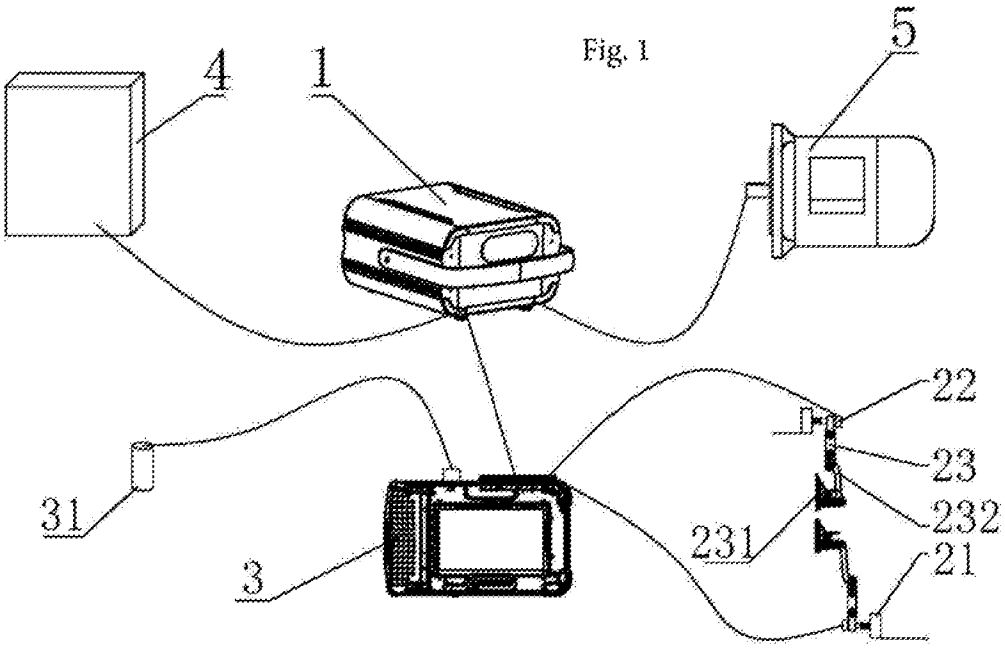
FIG. 1 is a schematic view of a system according to the invention.

As shown in FIG. 1, according to the invention, the system for testing an escalator mainly comprises a hand-held manipulator, an actuator 1, a sensor and a trigger 31, which can be assembled on site and used with convenience. The whole detection process can be completed in 10 minutes by two professional inspectors.

In detail, the actuator 1 is connected in series between the control cabinet 5 and the motor 4, based on variable-frequency technology to change the running speed and direction of the escalator to be tested by varying the power supply frequency and phase of the motor, thereby to achieve the simulation of overspeed or unintentional reversal faults. The sensor is attached to a step or a handrail belt of the escalator, for collecting signals and transmitting the signals collected to an operation device 3 for signal digital processing the displaying. Served as a control center in the invention, the operation device 3 controls the actuator 1, for different test items and procedures, enabling the motor 5 and the escalator to simulate various dangerous conditions, such as accident acceleration or unintentional reversal, for the desired quantitative signal detection. It should be noted that, connection lines between the control cabinet 4 and the motor 5 should be removed before the tests of overspeed and unintentional reversal functions are started.

The operation device 3 of the system is integrated with a set of modules, including an overspeed protection and detection module, an unintentional reversal p protection and detection module, a speed deviation protection testing module, a handrail synchronization error protection testing module, a braking distance and deceleration testing module, a data recording module, and so on. Wherein each of the modules, via the operation device 3, can control the actuator 1 to actuate, so that the system can simulate a plurality of important protection function tests for an escalator respectively: an overspeed protection function test, an unintentional reversal protection test, a speed deviation detection test, a handrail synchronization deviation detection test, a braking distance test, a braking deceleration test, an additional braking test, and so on. As the system can simulate some critical accidental conditions, such as accidental overspeed and unintentional reversal, and monitor the actions and action speeds of the respective protection devices in real-time, the system of the invention can be used as a powerful tool to reproduce the processes of the overspeed and reversal accident conditions, and provide evidence for accident investigation.

Regarding the connections within the system, first, the trigger 31 is connected to the operation device 3 via a connecting line, the sensor is connected to the operation device 3 by a sensor signal line, and the actuator 1 is connected to the operation device 3 by a control line, wherein both the input and output interfaces of the actuator 1 are aviation joints. While being connected, the plugs of the aviation joints must be aligned with the corresponding socket bayonets, and a clamping ring is screw in after the plugs are inserted into the socket bayonets. Wherein, the operation device 3 is connected with a trigger 31, for some special tests, such as an emergency stop operation in the braking distance test and braking deceleration test.

Figure 2:
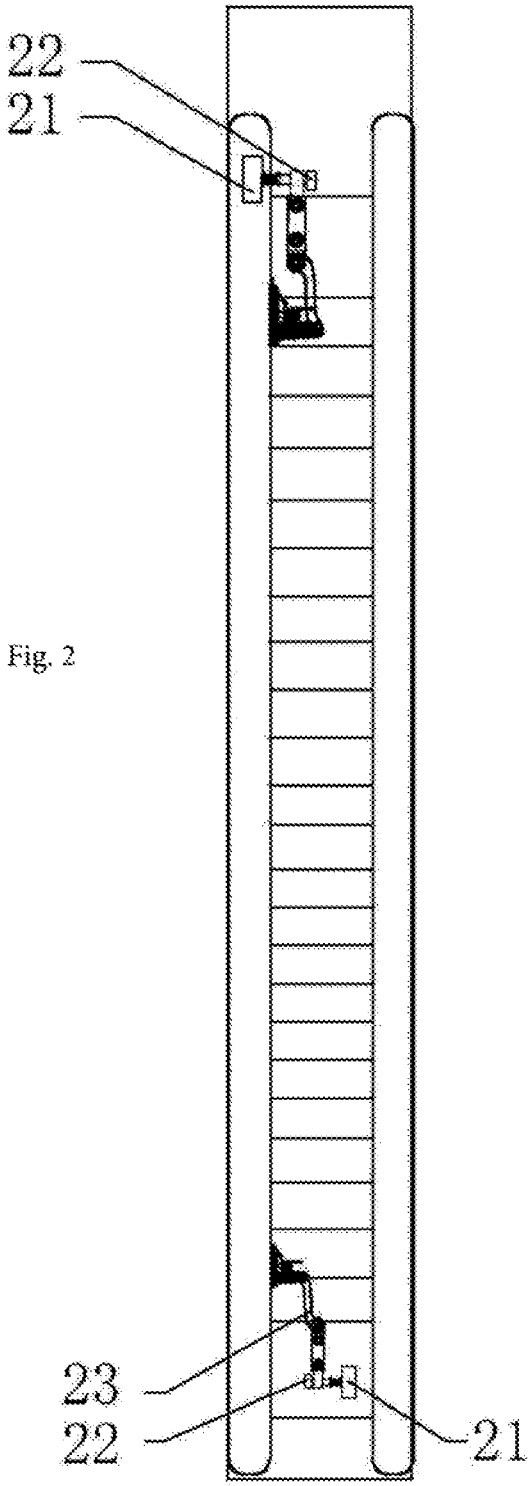
FIG. 2 is a schematic view of an arrangement of sensors according to the invention.

As shown in FIG. 2, to install the sensor, first a rubber wheel 21 is connected coaxially with a rotary encoder 22, and then the rubber wheel 21 and the rotary encoder 22 assembled is further connected with a support 23, wherein the support 23 comprises a suction cup 231 and swing arm 232 connected. The suction cup 231 is attached onto a horizontal section of the escalator in a suitable position. The swing arm 232 is adjustable to allow the rubber wheel 21 of the sensor to be tightly attached to the horizontal section or handrail belt of the escalator. The rubber wheel 21, which is in direct contact with the escalator, may be a wear-resistant rubber wheel with a standard diameter of 20 cm, and is coaxially connected with the rotary encoder 22 by an elastic coupling. When the rubber wheel 21 rotates with the escalators, the rotary encoder 22 synchronously rotates and generates a pulse signal. The pulse signal is transmitted to the operation device 3, so that the current speed of the step or the handrail belt of the escalator is gained. While the sensor has been installed, the connection line of the sensor should be adjusted where necessary, friction and entanglement with the moving components of the escalator are not allowed.

Figure 3:
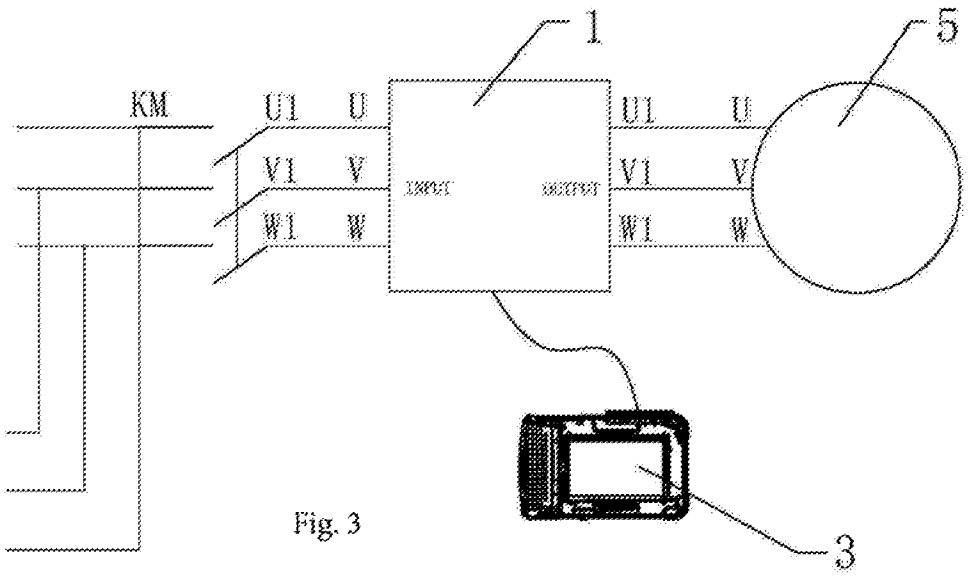
FIG. 3 is a schematic view of connections between the motor and the driver according to the invention.
Figure 4:
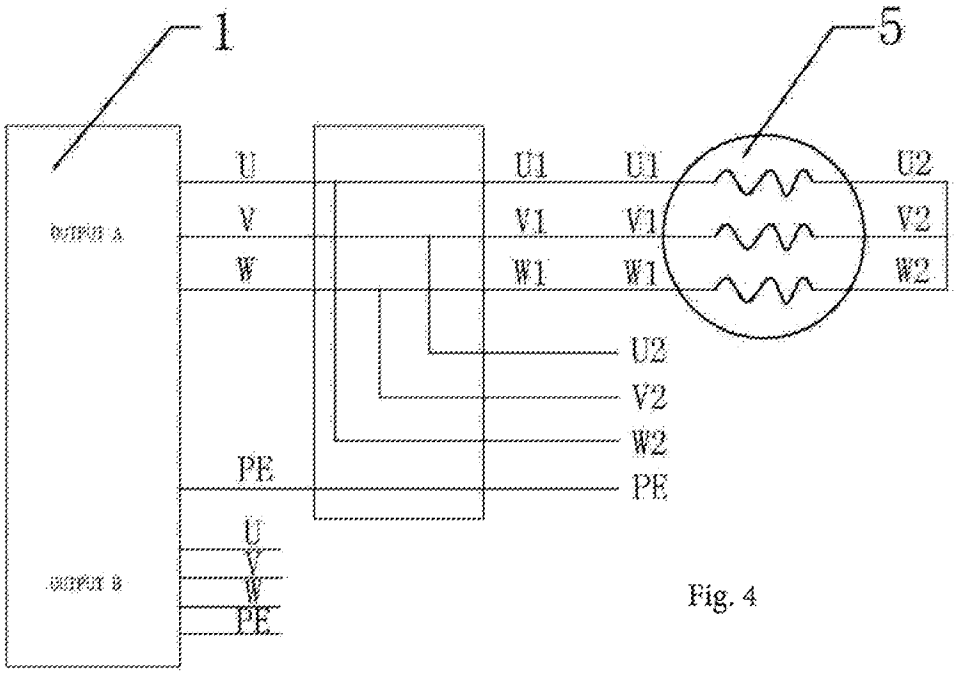
FIG. 4 is another schematic view of connections between the motor and the driver according to the invention.

As shown in FIG. 3, to connect the actuator 1 to the motor 5, output lines U1, V1, W1 of the actuator 1 are connected with input lines U, V, W of the motor 5. As shown in FIG. 4, if the escalator is under a star-delta startup mode, the output lines U1, V1, W1 of the actuator 1 are connected with the input lines U1, V1, W1 of the motor 5, and input lines U2, V2, W2 of the motor 5 are short connected.

The connection between the actuator 1 and the control cabinet 4 should be determined by the schematic circuit diagram of the escalator. For a frequency driving mode, the three input lines of the actuator 1 are connected with the output terminals U1, V1, W1 of the control cabinet of the escalator, respectively (regardless of the order), after the connection between the control cabinet 4 and the motor 5 is removed. For variable frequency driving, a further step of determining the startup mode of the escalator according to the schematic circuit diagram of the escalator is required. If a full variable frequency startup mode is applied, first the inverter of the control cabinet 4 of the escalator should be set into an unloaded output mode, the subsequent connection is the same as the escalator with the frequency driving mode. If a bypass variable frequency startup mode is applied, the escalator should be set into a frequency startup mode by a professional, the subsequent connection is the same as the escalator with the frequency driving mode.

In addition to the above, the invention further provides a method for testing an escalator. With the integrated test system for an escalator described above, the method comprises:

Step 1. system startup: pressing a power switch of the operation device 3 to start up the system and to initialize a communication test, and proceeding to a next step if the communication is good;

Step 2. parameter setting: entering an ID number of an escalator to be detected and corresponding information of data to be measured, in a parameter setting interface;

Step 3. test selection: selecting a specific functional test for the operation device 3 to control the actuator 1 to drive the escalator to simulate corresponding test conditions;

Step 4. data collection: collecting the data of the step or the handrail belt of the escalator in real time by the operation device 3, and processing, displaying and saving the data;

Step 5. repeating Step 3 until the detection is completed.

A specific test is selected to elaborate the testing process of the invention.

1. Unintentional Reversal Protection Function Test

A user may press the power switch of the operation device 3 to start up the system, and a home screen is presented; click a "communication test" button on the home screen to initialize the communication test, the screen may show "communication is good" if the communication test is passed; click a "test selection" button to select a specific test, before that, parameters for specific test should be set, i.e. entering the ID and information of the data to be collected for the escalator to be detected, respectively, in one or more parameter setting dialogs; click a "next escalator" button, and a test function selection interface is presented, and a new group of data record is created according to the current ID.

The user may then click a "reversal test" button to start the unintentional reversal protection test; click an "up-direction" button and turn on the escalator by a key switch, such that the escalator enters an upward running state; click a "verified, next step" button on a lower right corner of the screen; while the escalator runs steadily, click a "reversal" button to enable the escalator to simulate working under the unintentional reversal conditions, for an accurate test on the unintentional reversal protection function of the escalator, wherein the escalator runs with a constant deceleration to simulate working in the dangerous conditions of unintentional reversal, while the unintentional reversal protection device of the escalator acts, the operation device 3 automatically locks and displays the action speed; at this time, click a "save data" button to save the action speed of reversal protection. If the unintentional reversal protection device does not act, the escalator will slow down and then speed up in a reverse direction, i.e. downwards, to a steady running state.

2. Overspeed Protection Function Test

Based on the above pre-test works, the user may click an "overspeed test" button to enable the escalator to enter an overspeed protection test; click a "down-direction" button and turn on the escalator into a downward running state by a key switch; click a "verified, next step" button on the lower right corner of the screen, then click an "overspeed" button to start the overspeed protection function test while the escalator runs steadily, wherein the escalator simulates working in the dangerous conditions of overspeed with a constant acceleration, when an overspeed protection switch of the escalator acts, the operation device 3 automatically locks and displays the action speed. At this time, the user can click the "save data" button to save the overspeed action speed.

3. Braking Distance Test and Braking Deceleration Test

Based on the above pre-test works, the user may click a "braking test for an escalator" button to enable the escalator to enter a braking test; click a "down-direction" button and turn on the escalator into a downward running state by a key switch; click the "verified, next step" button, and press an emergency stop button of the escalator with the trigger 31 to stop the escalator after the escalator runs steadily. The operation device 3 locks and displays maximum braking distance data and maximum braking deceleration data in its screen, the user may click the "save data" button to save the data.

4. Record Query

If there is a need to retrieve the data, the user may click a "record query" button to enter a historical record query interface, on which the operation device 3 displays the data of the escalator recently detected by default. If further requiring the data of another escalator, just enter a corresponding ID number.

In conclusion, the system of the invention has a scientific design, high precision and high systematic integration, and meets the requirements of the provincial standard of Guangdong DB44/T1137-2013 "Testing methods for protection against overspeed and unintentional reversal of the travel direction of escalators and moving walks". The system of the invention has the following beneficial effects:

1. The system has a strong universality, applicable to both frequency and variable frequency escalators.

2. The detection method of the invention is regardless of types of the protection devices, overcoming the defects that the test result is not accurate even the test cannot be done for some devices in the existing art.

3. The user of the system can directly observe the information about the action speed of the protection devices in real-time, a precise quantitative detection is thus provided.

4. An industrial touch screen is used for user to control the system, for a simple operation and a friendly interface;

5. The system provides a function for user to save and query the historical test data records.

In addition, when using the system, the user may note that:

If it is found that the escalator can not be started normally during the testing process, and a yellow light of the drive 1 is on, checking the connections of the input and output lines of the actuator 1 is suggested. In this case the problem is usually caused by input or output open phase, the escalator can be started normally after the lines are reconnected.

If during the detection process it is found that the travelling direction of the escalator is opposite to the preset/expected direction, swapping the output lines of the actuator 1 can solve the problem, this could easily change the travelling direction of the escalator.

Before any electrical operations, such as removing, shorting out and connecting, a professional should cut off the main power switch and conduct a measurement with a multimeter to ensure that the electrical operations are conducted safely.

Optional embodiments of the present invention may also be said to broadly consist in the parts, elements and features referred to or indicated herein, individually or collectively, in any or all combinations of two or more of the parts, elements or features, and wherein specific integers are mentioned herein which have known equivalents in the art to which the invention relates, such known equivalents are deemed to be incorporated herein as if individually set forth.

Although a preferred embodiments has been described in detail, it should be understood that various changes, substitutions, and alterations can be made by one of ordinary skill in the art without departing from the scope of the present invention.

It will be appreciated that various forms of the invention may be used individually or in combination.

The invention claimed is:

1. A system for testing an escalator, comprising:

a control cabinet (4);

a motor (5) coupled with said control cabinet (4) and receiving signals from said control cabinet (4);

an actuator, removable connected in series between the control cabinet (4) and the motor (5), said actuator adapted to actuate the escalator to simulate overspeed or reversal, while connected for testing, by varying the power supply frequency and phase of the motor;

at least one sensor, mounted on a step or a handrail belt of the escalator for quantitative detection of speed signals in communication with said control cabinet (4); and an operation device, connected to the actuator and the at least one sensor, said operation device adapted to control the actuator for different test items, and said operation device comprising a processor and display for processing and displaying the speed signals detected.

2. The system according to claim 1, wherein based on variable-frequency, the actuator (1) adapted to modify the running speed and direction of the escalator by varying the power frequency and phase of the motor (5), for overspeed or reversal simulation.

3. The system according to claim 2, wherein the actuator (1) is connected to the operation device (3) via a control line.

4. The system according to claim 1, wherein the operation device (3) is integrated with an overspeed protection testing module, an unintentional reversal protection testing module, a speed deviation testing module, a handrail synchronization error testing module and a braking distance and speed reduction testing module.

5. The system according to claim 1, wherein the sensor comprises a rubber wheel (21), a rotary encoder (22) and a support (23), the rubber wheel (21) and the rotary encoder (22) are connected coaxially and mounted on a horizontal section of an apron of the escalator or a horizontal section of a glass wall of the escalator by the support (23).

6. The system according to claim 5, wherein the support (23) comprises a suction cup (231) through which the sensor is fixed, and a swing arm (232) through which the sensor is in close contact with a horizontal section of a step of the escalator or a handrail belt of the escalator.

7. The system according to claim 1, wherein the operation device (3) is a hand held manipulator, comprising a trigger (31).

8. The system according to claim 1, wherein the operation device (3) comprises a data recording module.

9. A method for testing an escalator, with the system having a control cabinet, a motor, an actuator connected in series between the control cabinet and the motor, at least one sensor mounted on a step or a handrail belt of the escalator, and an operation device connected to the actuator and the sensor controlling the actuator for different test items, comprising the following steps:

Step 1: removable connecting the actuator (1) in series between the control cabinet (4) and the motor (5);

Step 2: system startup: pressing a power switch of the operation device (3) to initial the system and a communication test, if the communication test is passed, proceeding to next step;

Step 3: parameter setting: entering an ID number of an escalator to be tested and associated information of data to be measured in a parameter setting interface;

Step 4: test selection: selecting a specific functional test to enable the operation device (3) to control the actuator (1) to drive the escalator to simulate respective test conditions by varying the power supply frequency and phase of the motor (5);

Step 5: real-time acquisition of data to be measured: acquiring the data of the step or the handrail belt in real-time by the operation device (3), and processing, displaying and saving the data; and Step 6: step repetition: repeating step 3 until the test is completed.

* * * * *